US010648762B2

(12) United States Patent
Jonas, IV

(10) Patent No.: US 10,648,762 B2
(45) Date of Patent: May 12, 2020

(54) ARCHERY BOW STABILIZER

(71) Applicants: Brian H. Hamm, Wisconsin Rapids, WI (US); Christopher A. Hamm, Wisconsin Rapids, WI (US)

(72) Inventor: LeRoy W. Jonas, IV, Wausau, WI (US)

(73) Assignees: Christopher A. Hamm, Wisconsin Rapids, WI (US); Brian H. Hamm, Wisconsin Rapids, WI (US)

( * ) Notice: Subject to any disclaimer, the term of this patent is extended or adjusted under 35 U.S.C. 154(b) by 0 days.

(21) Appl. No.: 16/455,321

(22) Filed: Jun. 27, 2019

(65) Prior Publication Data

US 2020/0003519 A1 Jan. 2, 2020

Related U.S. Application Data

(60) Provisional application No. 62/691,055, filed on Jun. 28, 2018.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/89
See application file for complete search history.

(56) References Cited

U.S. PATENT DOCUMENTS 3,468,297 A * 9/1969 Cress ..... F41B 5/1426 124/88
3,683,883 A * 8/1972 Izuta ..... F41B 5/1426 124/89
4,245,612 A * 1/1981 Finlay ..... F41B 5/1426 124/89
4,570,608 A * 2/1986 Masterfield ..... F41B 5/1426 124/89
4,660,538 A * 4/1987 Burgard ..... F41B 5/1426 124/88
4,718,647 A * 1/1988 Ludwig ..... F16F 9/585 188/322.15
4,779,602 A * 10/1988 Hess, Sr. ..... F41B 5/1426 124/88
4,893,606 A * 1/1990 Sisko ..... F41B 5/1426 124/89
4,982,719 A * 1/1991 Haggard ..... F41B 5/1426 124/23.1
4,986,018 A * 1/1991 McDonald, Jr. ..... F41B 5/1426 124/89
5,273,022 A * 12/1993 Leven ..... F41B 5/1426 124/88

(Continued)

OTHER PUBLICATIONS

Beiter article dated Sep. 2005 titled the Beiter Centralizer.
Portion of 1989 Archery Catalog by HHA Sports.
Portion of 1987-1988 Brochure by HHA Sports.

*Primary Examiner* — Alexander R Niconovich
(74) *Attorney, Agent, or Firm* — Shane Delsman; Godfrey & Kahn, S.C.

(57) ABSTRACT

A stabilizer for an archery bow with adjustable weight that, when attached to a bow, permits the center of gravity and balance of the bow to be changed. The stabilizer includes a tubular housing, a weight positioned within the tubular housing and a knob that may be rotated to move the weight within the tubular housing.

20 Claims, 6 Drawing Sheets

(56) References Cited

U.S. PATENT DOCUMENTS 5,370,104 A * 12/1994 Neie ..... F41B 5/1426 124/89
5,388,563 A * 2/1995 Hsu ..... F41B 5/1426 124/23.1
5,390,656 A * 2/1995 Villa ..... F41B 5/1426 124/89
5,460,156 A * 10/1995 Sappington ..... F41B 5/1426 124/89
5,471,969 A * 12/1995 McDonald, Jr. ..... F41B 5/1426 124/86
5,617,664 A * 4/1997 Troncoso ..... F41A 3/80 124/89
5,669,370 A * 9/1997 Breedlove ..... F41B 5/1426 124/89
5,735,257 A * 4/1998 Walk ..... F41B 5/1426 124/89
5,904,134 A * 5/1999 Denbow ..... F41B 5/1426 124/89
5,975,070 A * 11/1999 Sands ..... F41B 5/1426 124/89
6,021,770 A * 2/2000 Sodaro ..... F41B 5/1426 124/86
6,076,514 A * 6/2000 Adams, Jr. ..... F41B 5/1426 124/89
6,186,135 B1 * 2/2001 Harwath ..... F41B 5/1426 124/89
6,283,109 B1 * 9/2001 Wiseby ..... F41B 5/1426 124/89
6,588,414 B2 * 7/2003 McMillan, III ..... F41B 5/1426 124/88
6,681,755 B2 * 1/2004 Pujos ..... F41B 5/1426 124/89
6,817,352 B1 * 11/2004 Saunders ..... F41B 5/1426 124/89
7,213,590 B2 * 5/2007 Pellerite ..... F41B 5/1426 124/89
9,016,268 B2 * 4/2015 Leven ..... F41B 5/1426 124/89
9,038,618 B1 * 5/2015 Bomar ..... F41B 5/1426 124/86
9,952,014 B2 * 4/2018 Omre ..... F41B 5/1426
10,132,590 B2 * 11/2018 Leven ..... F41B 5/1426
2012/0240913 A1 * 9/2012 Stokes ..... F41B 5/1426 124/89
2016/0195356 A1 * 7/2016 Roady ..... F41B 5/14 124/87

* cited by examiner

ARCHERY BOW STABILIZER

CROSS REFERENCE TO RELATED APPLICATION

This application claims the benefit of and priority to U.S. Provisional Patent Application Ser. No. 62/691,055, filed Jun. 28, 2018, the disclosures of which are hereby incorporated by reference herein in their entirety for all purposes.

FIELD

The present disclosure generally relates to archery bows for hunting and target applications, and more particularly to stabilizers for archery bows.

BRIEF DESCRIPTION OF THE DRAWINGS

The accompanying drawing figures, which are incorporated in and constitute a part of the description, illustrate several aspects of a stabilizer, and together with the description, serve to explain the principles of the stabilizer. The following description is based on embodiments of the stabilizer and should not be taken as limiting the stabilizer with regard to alternative embodiments that are not explicitly described herein. A brief description of the figures is as follows.

Figure 1:
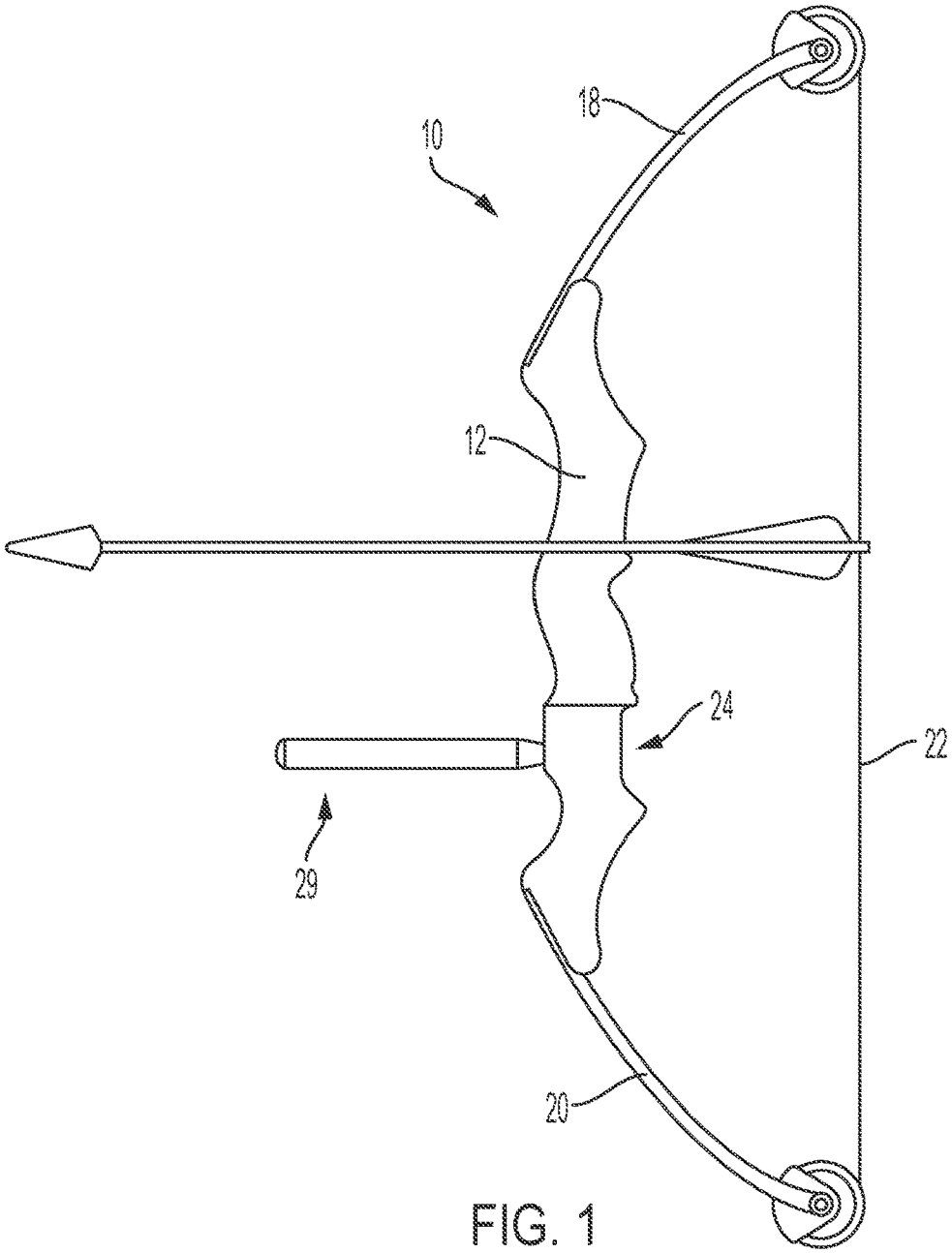
FIG. 1 is a side elevation view of an archery bow with an embodiment of a stabilizer coupled thereto.

In view of the many possible embodiments to which the principles of the stabilizer may be applied, it should be recognized that the embodiments described herein with respect to the drawing figures are meant to be illustrative only and should not be taken as limiting the scope of the invention.

DETAILED DESCRIPTION

Various conventional types of stabilizers are used by archers to improve accuracy by reducing or eliminating vibrations before and after an arrow is released. Some archery bows include dampening components, such as rubber discs, that dampen vibrations caused when shooting the arrow. Furthermore, the stabilizers help the archer achieve balance of the bow. That is, stabilizers help offset weight of the bow in various directions to achieve the balance desired by the archer.

Several factors influence the type of stabilizer utilized by the archer. For example, archery bows may not be manufactured with perfect balance due to manufacturing tolerances and/or defects during molding, machining, and assembling processes. In addition, the archer may add or attach different accessories, such as visual sights, arrow rests, quivers, and grips, to the bow after purchase to aid in shooting accurately. These accessories change the weight and balance of the archery bow. With some conventional stabilizers, additional weights are added to the stabilizer to thereby change the weight and/or balance of the archery bow.

Through research and development, the inventor has determined that archers could benefit from stabilizers that are adjustable and permit the archer to change the balance of the archery bow while in use or "on-the-fly" without additional equipment or components. The present inventor has also observed that many archers strive to find a stabilizer position (e.g. the distance the stablizer's center of gravity is away from the bow) that balances the bow in the shooters hand.

Accordingly, there is a need for a stabilizer that permits an archer to adjust the stabilizer with little effort and without additional tools or components. Furthermore, there is a need for a stabilizer to assist the archer in achieving desired balance of the archery bow and reducing vibrations in the archery bow.

It will be understood by those skilled in the art that one or more aspects of the stabilizer embodiment(s) described below can meet certain objectives, while one or more other aspects can lead to certain other objectives. Other objects, features, benefits and advantages of the stabilizer will be apparent in this description of the disclosed embodiments, and will be readily apparent to those skilled in the art. Such objects, features, benefits and advantages will be apparent from the above as taken in conjunction with the accompanying figures and all reasonable inferences to be drawn therefrom.

Figure 2:
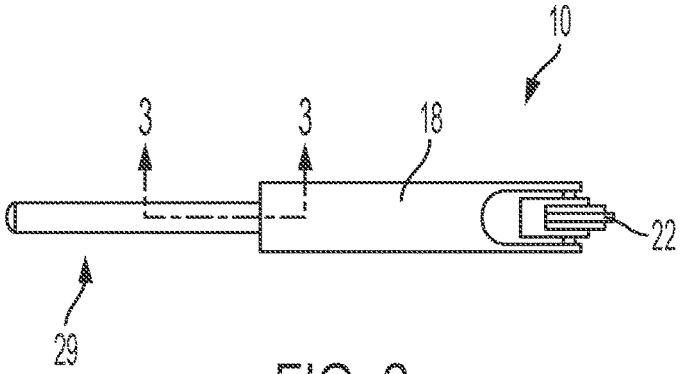
FIG. 2 is a top plan view of the bow and stabilizer of FIG. 1.
Figure 3:
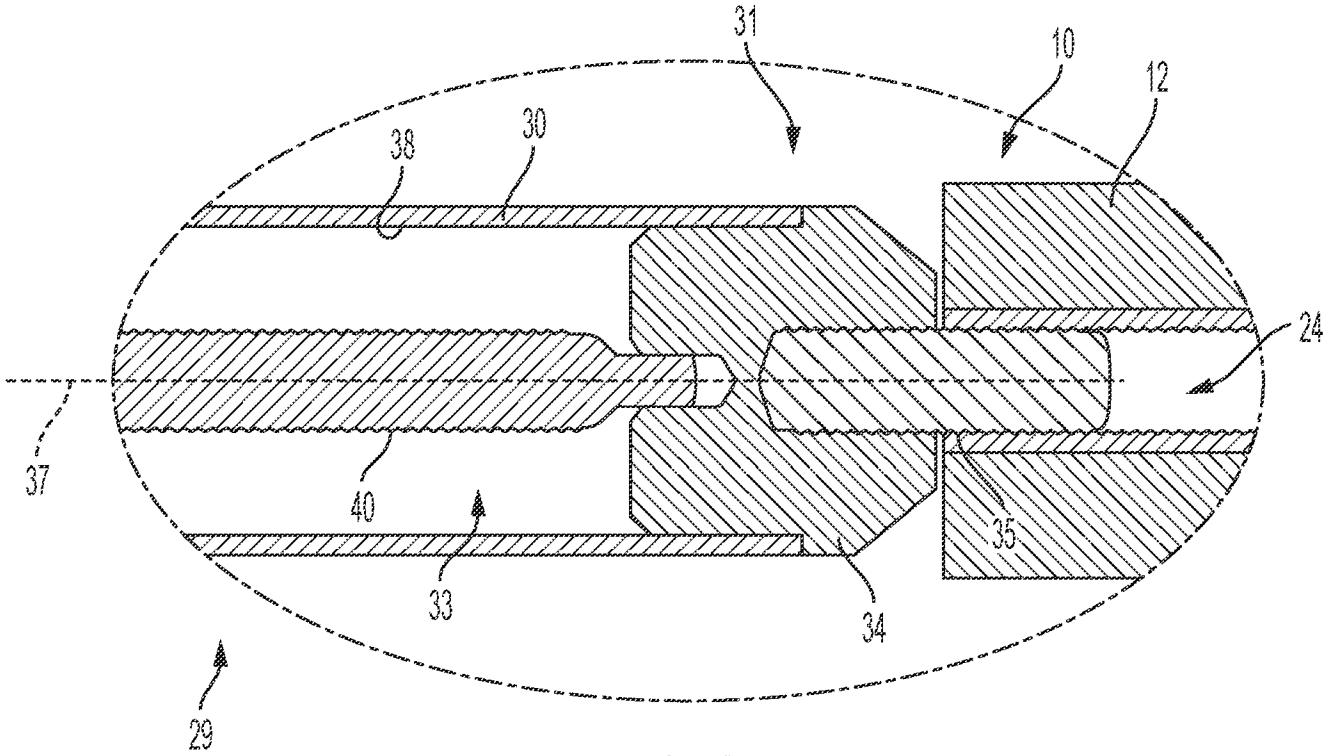
FIG. 3 is an enlarged partial cross sectional view of the archery bow and the stabilizer of FIG. 2 taken along the line 3-3.
Figure 4:
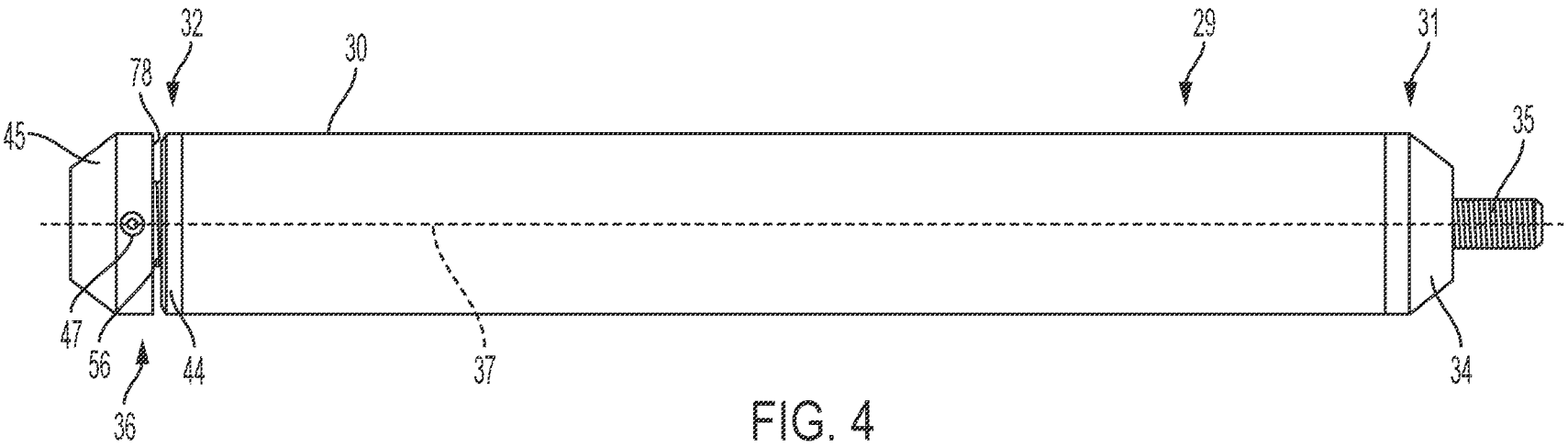
FIG. 4 is a side elevation view of a stabilizer.
Figure 5:
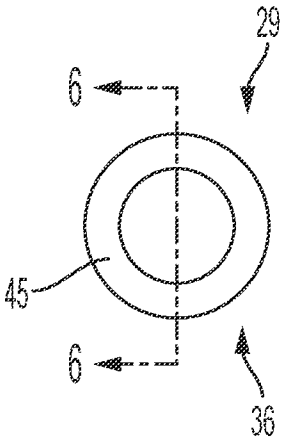
FIG. 5 is an end elevation view of the stabilizer of FIG. 4.

Referring to FIGS. 1-2, an archery bow 10 is depicted with a stabilizer 29. Although one type of archery bow 10, a compound bow, is shown and one specific mounting location is shown, the stabilizer 29 could be used with other types of archery bows, for example a recurve bow, and/or mounted at other locations on the bow, for example in a threaded bore on the opposite side of the handle 12 such that the stabilizer projects towards the string 22, without defeating the spirit of the invention. The archery bow 10 shown in FIG. 1 has a handle 12, an upper arm 18, a lower arm 20, and a string 22 that connects the upper arm 18 to the lower arm 20. As seen in FIG. 3, the handle 12 defines a threaded bore 24 in which a threaded rod or fastener 35 of the stabilizer 29 is received to thereby connect or removably attach the stabilizer 29 to the archery bow 10. The stabilizer 29 is depicted in greater detail in FIGS. 4-6.

Figure 6:
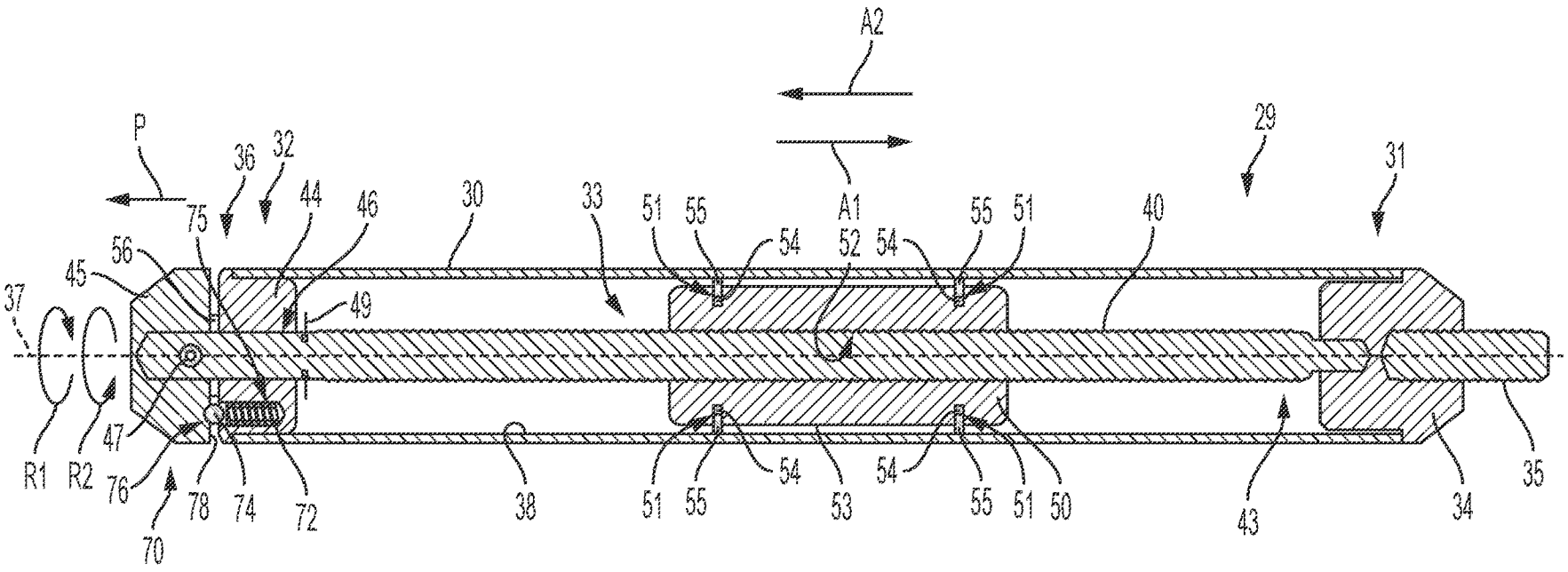
FIG. 6 is a cross sectional view of the stabilizer of FIG. 5 taken along line 6-6.

As seen in FIG. 6, the stabilizer 29 has a tubular housing or frame 30 with an interior surface 38, a first end 31, and an opposite or second end 32. The housing 30 extends along an axis 37 and defines an interior cavity 33 elongated between the ends 31, 32 and along the axis 37. The components of the stabilizer 29 described herein can be made out of any suitable material such as plastic, metal, carbon fiber, and the like. In one embodiment, the tubular housing 30 is made from a carbon fiber material.

A fixed cap 34 is fixedly coupled to the first end 31 of the housing 30. In the embodiment seen in FIG. 7, the fixed cap 34 includes spiral grooves for a glue, epoxy or other adhesive such that when the fixed cap is inserted into the tubular frame 30, the glue is not scraped off. However, other means for attaching a cap to a frame is known, for example integrally forming, threads, welding, fasteners, friction, the use of which would not defeat the spirit of the invention. In the embodiment seen in FIG. 6, the fixed cap 34 is partially positioned inside the cavity 33 such that a part of the fixed cap 34 is exposed and/or extends out of the tubular housing 30. The fixed cap 34 includes the threaded rod 35 that connects the stabilizer 29 to the handle 12 of the archery bow 10. In one embodiment, glue, epoxy, adhesive or other fastening means is applied to the threaded rod 35 and the threaded rod is threaded into a threaded hole in the fixed cap 34 to secure the threaded rod to the fixed cap. However, other means are known for securing a threaded rod to a fixed cap, e.g. integral forming, welding, bolting, the use of which would not defeat the spirit of the invention.

An adjustment cap 36 is rotatably coupled to the second end 32 of the housing 30. The second end 32 of the housing 30 has a fixed portion 44. In the embodiment seen in FIG. 6, a part of the fixed portion 44 is positioned inside the cavity 33 and another part of the fixed portion 44 is exposed and/or extends out of the tubular housing 30 at the second end 32. In the embodiment seen in FIG. 7, the fixed portion 44 includes spiral grooves for a glue, epoxy or other adhesive such that when the fixed portion is inserted into the tubular frame 30, the glue is not scraped off. However, other means for attaching a portion to a frame is known, including integrally forming, threads, welding, fasteners, friction, the use of which would not defeat the spirit of the invention. In the embodiment illustrated in FIG. 6, the fixed portion 44 includes a center bore or opening 46 that extends through the fixed portion 44. The adjustment cap 36 further includes an adjustment knob 45 rotatably coupled to the fixed portion 44.

Figure 7:
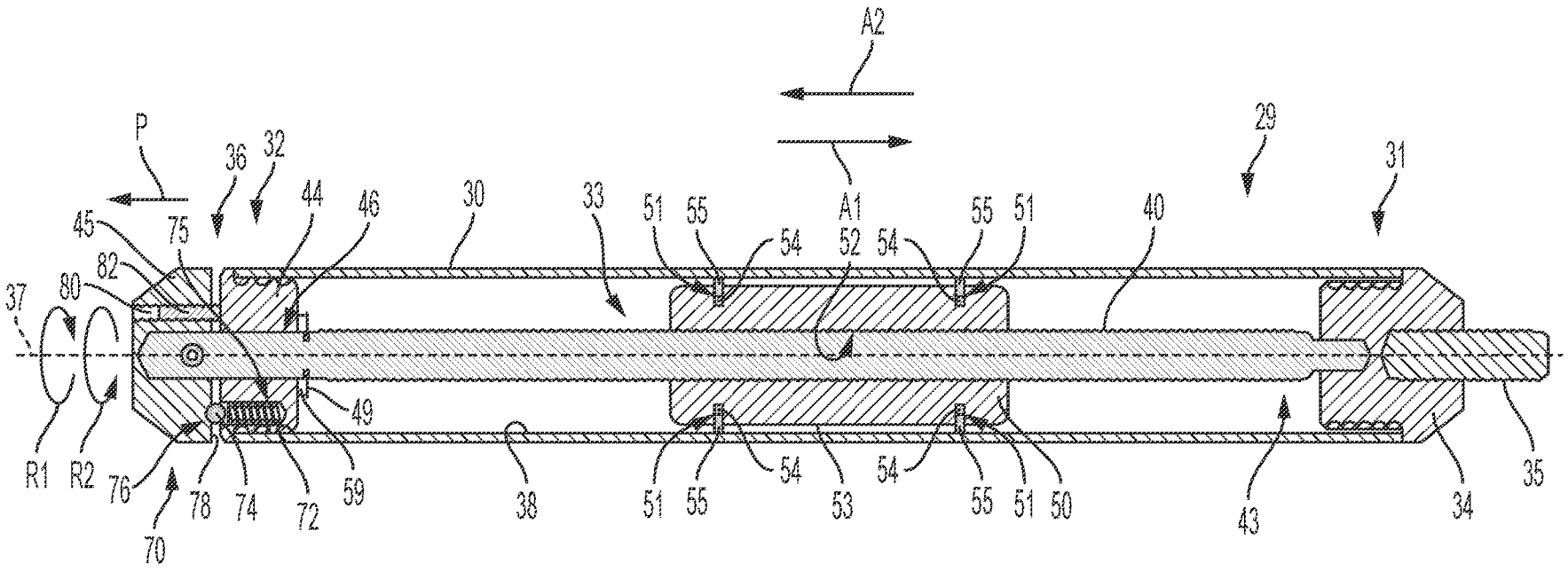
FIG. 7 is a cross sectional view of another embodiment of a stabilizer.

An externally threaded rod or shaft 40 is fixedly coupled or connected to the adjustment knob 45 and extends along the axis 37. In the embodiment seen in FIG. 6, the adjustment knob 45 is attached to the portion of the threaded rod 40 that extends through the bore 46 and out of the housing 30 by a dowel pin 47. However, other means are known for securing a threaded rod to a cap, e.g. threaded insert, integral forming, welding, glue, epoxy, adhesive or other fastening means, the use of which would not defeat the spirit of the invention. A plastic ring or washer 56, for example, an acetal homopolymer material, can be positioned between the adjustment knob 45 and the fixed portion 44, as seen in FIG. 6, or just an air gap, as seen in FIG. 7.

In the embodiment seen in FIG. 6, a snap ring 49 can be placed on the portion of the threaded rod 40 disposed in the interior cavity 33 adjacent the fixed portion 44 to prevent the threaded rod from moving within or being removed from the tubular housing 30. In the embodiment shown in FIG. 7, a washer, for example, made from a polytetrafluoroethene material, is position between the snap ring 49 and the fixed portion 44 to prevent a metal component from contacting another metal component. The washer could also be made from a resilient mater, such as rubber, to further improve the dampening ability of the stabilizer.

A first end of the threaded rod 40 extends through the bore 46 of the fixed portion 44 and into the open cavity 33 defined by the housing 30. The threaded rod 40 has a distal or second end 43 (opposite the end that is coupled to the adjustment knob 45) that is rotatably supported by the fixed cap 34. In the embodiment seen in FIG. 6, a portion of the distal end 43 of the threaded rod 40 is rotatably located or held within a bore in the fixed cap 34. In operation, rotation of the adjustment knob 45 causes the threaded rod 40 to rotate within the cavity 33.

An internal weight 50 is positioned in the cavity 33 and has an internally threaded bore 52 in which the threaded rod 40 is received. Although the bore 52 is shown as completely threaded, the bore could be partially threaded. The internal threads of the internal weight 50 engage with the external threads of the threaded rod 40. The weight 50 could alternatively be moved within the cavity 33 by a number of mechanisms know in the art the use of which would not defeat the spirit of the invention. For example, a gearing mechanism could be used instead of a threaded mechanism, such as a worm gear.

The internal weight 50 includes an outer surface 53. A pair of externally recessed grooves 51 are formed in the outer surface 53 of the weight 50. Each of the recessed grooves 51 receives a compressible ring, such as an O-ring 54 and a plastic ring 55. However, more or less recessed grooves, such as seen in the embodiment shown in FIG. 7, could be used without defeating the spirit of the invention. As seen in FIG. 6, the O-rings 54 are positioned between the weight 50 and a plastic ring 55 such that the plastic ring is positioned at least partially within the groove 51 and extends beyond the outer surface 53. The plastic rings 55 are sized to contact the interior surface 38 of the housing 30 and are made from a material that permits the plastic rings to slide along the interior surface. In the embodiment seen in FIG. 6, the O-rings 54 are made from a resilient rubber material and the plastic rings 55 are made from a polytetrafluoroethene material. The O-rings 54 create a bias force on the plastic ring 55 to press the outer surface of the plastic ring 55 against the interior surface 38 of the housing 30. In this embodiment, the combination of the O-rings 54 and plastic rings 55 create a source of friction with or tensile force against the interior surface 38 of the housing 30 to prevent undesired rotation of the threaded rod 40 or the internal weight 50 within the cavity 33 and/or movement along the internal threaded rod 40. Alternatively, just an O-ring, such as a lubricated O-ring, or just a plastic ring could be used, as seen in the embodiment shown in FIG. 7, or other projections, overmolds or other devices to engage or contact the interior surface, without defeating the spirit of the invention.

The combination of the O-rings 54 and plastic rings 55 cushion the internal weight 50 against the interior surface 38 such that the internal weight 50 moves smoothly within the cavity 33. The O-rings 54 and plastic rings 55 also reduce or eliminate rattling between the internal weight 50 and the housing 30. In one embodiment, the plastic rings 55 are a split ring, e.g. the ring has a removed portion, e.g. a notch, to allow the ring to be expanded such that it can be placed around the weight 50 and into the groove 51 where it can contract. The gap or notch in the ring can also allow a first side of the plastic ring 55 to be in fluid contact with a second side of the ring, such as by a passage of air through the plastic ring as the weight 50 moves within the cavity 33 and prevent the buildup of air pressure on either side of the plastic rings 55 during the movement of the weight 50 which allow easier movement of the weight and, thereby, the adjustment knob 45. Although in the embodiment shown in FIG. 6, air is described as being in the interior cavity 33, other materials are known in the art, e.g. oil, shock absorbing gel, foam, etc., the use of which would not defeat the spirit of the invention.

The internal weight 50 is moved along the threaded rod 40 as the adjustment knob 45 is rotated by the archer such that the archer can achieve balance of the archery bow 10. For example, when the adjustment knob 45 is rotated by the archer in a first rotational direction R1 the threaded rod 40 is rotated the first rotational direction R1 and the internal weight 50 is moved in a first axial direction A1 toward the first end 31 and the fixed cap 34. Similarly, when the adjustment knob 45 is rotated by the archer in a second or opposite rotational direction R2, the threaded rod 40 is rotated in the second rotational direction R2 and the internal weight 50 is moved in a second axial direction A2 toward the second end 32 and the adjustment cap 36. Accordingly, the archer can move the internal weight 50 by rotating the adjustment knob 45 until the desired or correct balance of the archery bow 10 is achieved.

In order to prevent the adjustment knob 45 (and the internal weight 50) from inadvertently moving, the adjustment cap 36 is provided with a locking assembly 70 that prevents inadvertent rotation of the adjustment knob 45. In the example depicted in FIG. 6, the locking assembly 70 is incorporated into the adjustment cap 36. In the embodiment shown, the locking assembly 70 includes a spring 72 coupled to the fixed portion 44 that urges a ball bearing 74 toward the adjustment knob 45. In the embodiment seen in FIG. 6, the spring 72 is positioned within a blind bore 75 of the fixed portion 44, such that the ball bearing 74 can be moved between a first portion in which the ball bearing is at least partially retracted into or within the blind bore and a second position in which the ball bearing is at least partially extended out of the blind bore.

The adjustment knob 45 may also have a corresponding detent 76 formed therein that receives at least a portion of the ball bearing 74 when the ball bearing is at least partially extended out of the blind bore 75 and the locking assembly 70 is in a locked position. While in the locked position, the adjustment knob 45 is not free to rotate relative to the fixed portion 44. In order to rotate the adjustment knob 45, a rotational force, sufficient to cause the detent 76 to push the ball bearing 74 toward the fixed portion 44 and thereby compress the spring 72 such that the ball bearing is least partially retracted into the blind bore 75 is applied by the archer to the adjustment knob 45, which is an increase of force as compared to the force when the ball bearing is not in a detent. Accordingly, further rotation of the adjustment knob 45 is then possible and the ball bearing 74 simply rolls along a bearing surface 78 of the knob 45 until the ball bearing 74 is forced back into the detent 76 by the spring 72 after one complete rotation of the adjustment knob 45. In other examples, multiple detents may be provided on the adjustment knob 45 such that the archer can "lock" rotation of the adjustment knob 45 after rotating the adjustment knob 45 less-than one full rotation or detents of different sizes used such that the archer can measure how much rotation is being applied, e.g. feeling four small clicks after one large click.

In an alternative embodiment, the threaded rod 40 could include one or more detents 76 and the blind bore 75 and spring 72 could be positioned perpendicular to the threaded rod such that the threaded rod is the bearing surface 78 for the ball bearing 74.

Figure 8:
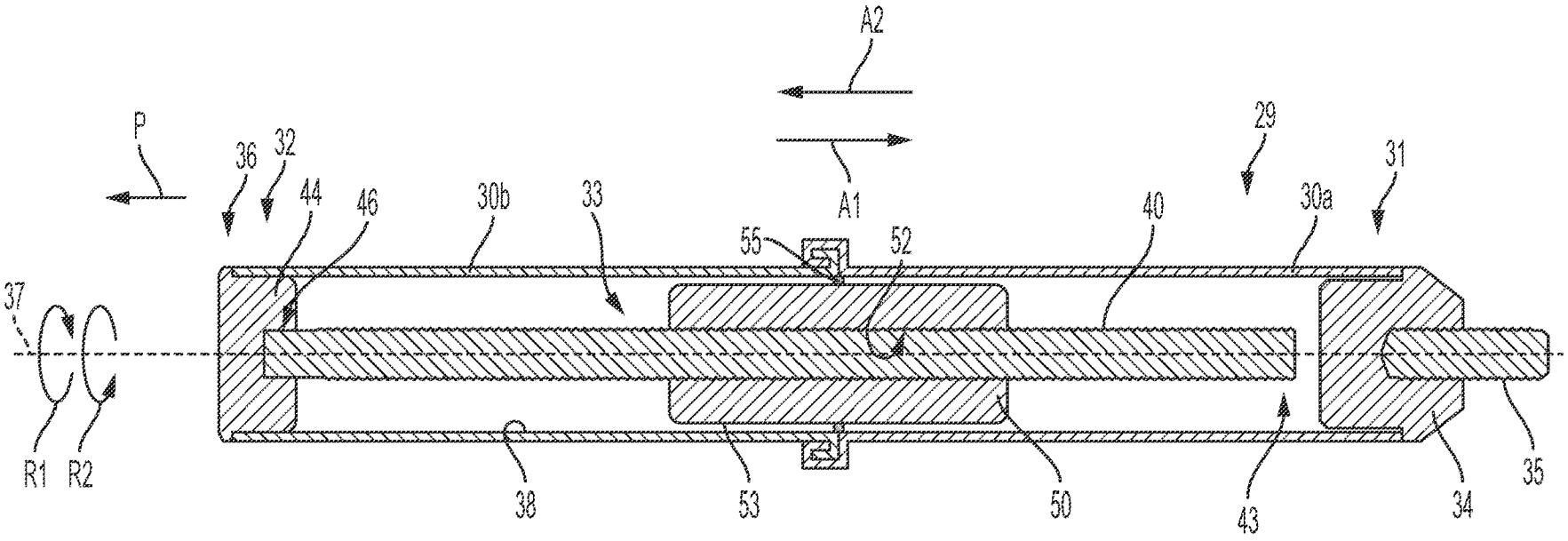
FIG. 8 is a cross sectional view of another embodiment of a stabilizer.

In the embodiment seen in FIG. 7, the adjustment knob 45 includes a threaded hole 80 and a threaded insert 82 threaded in the hole. When the desired position of the weight 50 is obtained, the threaded insert 82 may be threaded into the threaded hole 80 and into contact with the fixed portion 44. The compressive force applied by the threaded insert 82 and the combination of the snap ring 49 and washer 59, prevent the adjustment knob 45 from further rotation. This written description uses examples to disclose the invention, including the best mode, and also to enable any person skilled in the art to make and use the invention. The patentable scope of the invention is defined by the claims, and may include other examples that occur to those skilled in the art. For example, the threaded rod 40 need not be held in the cap 34 as the weight 50 may sufficiently hold the threaded rod as seen in FIG. 8. By way of another example, the tubular housing 30 could have a first part 30*a* and a second part 30*b* which are rotatably connected as shown in the embodiment seen in FIG. 8. The threaded rod 40 could be fixedly connected or secured to the second part 30*b* such that when the second part is rotated, the threaded rod is rotated and the weight 50 moved along an axis between the first and second end 32. For example, when the second part is rotated in the first direction, the weight is moved closer to the first end, and when the second part is rotated in the second direction, the weight is moved closer to the second end.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. Further, it is to be understood that in at least some embodiments, plurality can include one or more of an element.

What is claimed is:

1. A stabilizer for an archery bow:

a housing having a first end and a second end, the housing defining an interior cavity extending between the first and second ends;

a fixed cap coupled to the first end and configured to attach the stabilizer to the archery bow;

an adjustment cap coupled to the second end and having a rotatable adjustment knob;

a threaded rod disposed at least partially in the interior cavity and fixedly coupled to the adjustment knob such that when the threaded rod rotates, the adjustment knob rotates; and a weight in threaded engagement with the threaded rod, the weight configured such that when the adjustment knob is rotated, the threaded rod is rotated and the weight moves along the threaded rod within the interior cavity.

2. The stabilizer of claim 1, wherein a threaded bore is formed in the weight and wherein the threaded bore engages the threaded rod.

3. The stabilizer of claim 1, wherein the housing has an interior surface, and wherein the weight has at least one ring that contacts the interior surface.

4. The stabilizer of claim 3, wherein a first groove is formed in the weight and wherein the at least one ring is positioned at least partially within the first groove.

5. The stabilizer of claim 3, wherein the at least one ring has a removed portion such that a first side of the at least one ring is in fluid contact with a second side of the at least one ring.

6. The stabilizer of claim 4, wherein a compressible ring is positioned at least partially within the first groove between the at least one ring and the weight.

7. The stabilizer of claim 4, wherein a second groove is formed in the weight and wherein a second ring is positioned at least partially within the second groove.

8. The stabilizer of claim 1, wherein the threaded rod is fixedly coupled to the adjustment knob at a first end and is rotatably held by the fixed cap at a second end.

9. The stabilizer of claim 1, wherein a fixed portion is positioned at least partially in the second end of the housing.

10. The stabilizer of claim 9, wherein the fixed portion has a bore formed therein and wherein at least a part of the threaded rod extends through the bore.

11. A stabilizer for a bow, the stabilizer comprising:

a tubular frame having a closed first end and a closed second end;

a shaft with threads along at least a portion of the shaft at least partially positioned in the tubular frame;

a weight with a threaded bore, the threaded bore engages the threads of the shaft; and a knob attached to the shaft such that when the knob is rotated, the weight is moved between the closed first end and closed second end;

wherein the knob is configured to move the weight without disassembly of the stabilizer.

12. The stabilizer of claim 11, wherein the closed second end has an opening formed therein and a portion of the shaft extends through the opening and out of the tubular frame.

13. The stabilizer of claim 12, wherein the knob is attached to the portion of the shaft that extends out of the tubular frame.

14. The stabilizer of claim 13, wherein a snap ring is attached to the portion of the shall at least partially positioned in the tubular frame and adjacent an interior side of the closed second end.

15. The stabilizer of claim 13, further comprising a locking assembly such that the knob may be prevented from being rotated.

16. The stabilizer of claim 13, further comprising:

a detent formed in the knob;

a spring positioned within a blind bore in the closed second end; and a ball positioned at least partially within the blind bore at an end of the spring;

wherein when the knob is rotated, the spring urges the ball into contact with a surface of the knob; and wherein when the ball engages the detent, an increase of force is required to rotate the knob.

17. A stabilizer for a bow, the stabilizer comprising:

a tubular frame having a first part with a first end and a second part with a second end;

a fastener attached to the first part configured to removably attach the first part of the tubular frame to the bow;

a threaded rod fixedly connected to the second part; and a weight positioned within the tubular frame and engaged with the threaded rod;

wherein the first part is rotatably attached to the second part;

wherein, when the second part is rotated, the threaded rod is rotated and the weight is moved along an axis between the first end and second end; and wherein the weight is configured to be moved while the weight is positioned within the tubular frame.

18. The stabilizer of claim 17, wherein the knob is configured to be rotated between a first direction and a second direction;

wherein when the second part is rotated in the first direction, the weight is moved closer to the first end; and wherein when the second part is rotated in the second direction, the weight is moved closer to the second end.

19. The stabilizer of claim 18, further comprising a ring positioned around the weight and in contact with an interior surface of the tubular frame.

20. The stabilizer of claim 19, wherein the ring is made from a resilient material such that the ring applies a tensile force against the interior surface of the tubular frame.

* * * * *